US012085082B2

(12) United States Patent
Kjellnes et al.

(10) Patent No.: US 12,085,082 B2
(45) **Date of Patent: *Sep. 10, 2024**

(54) THRUST-BALANCING WET GAS COMPRESSOR

(71) Applicant: ONESUBSEA IP UK LIMITED, London (GB)

(72) Inventors: Hans Fredrik Kjellnes, Nesttun (NO); Åsmund Valland, Sandsli (NO); Joakim Almqvist, Sandsli (NO); Thomas Bucher-Johannessen, Sandsli (NO); Marius Askevold, Sandsli (NO)

(73) Assignee: ONESUBSEA IP UK LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/582,567

(22) Filed: Jan. 24, 2022

(65) Prior Publication Data

US 2022/0220963 A1 Jul. 14, 2022

Related U.S. Application Data

(63) Continuation of application No. 16/536,547, filed on Aug. 9, 2019, now Pat. No. 11,231,039.

(Continued)

(51) Int. Cl.
*F04D 19/02* (2006.01)
*F04D 29/051* (2006.01)

(52) U.S. Cl.
CPC ..... *F04D 19/024* (2013.01); *F04D 29/051* (2013.01)

(58) Field of Classification Search
CPC ..... F04D 3/00; F04D 13/08; F04D 13/086; F04D 19/024; F04D 29/041;

(Continued)

(56) References Cited

U.S. PATENT DOCUMENTS 2,451,944 A 10/1948 Hall
3,379,366 A 4/1968 Garnier (Continued)

FOREIGN PATENT DOCUMENTS

FR 1537797 A * 8/1968 ..... F02K 3/00
GB 1207873 A 10/1970

OTHER PUBLICATIONS

Machine translation of FR1537797A, Bruneau et al, published Aug. 30, 1968 (Year: 1968).*

(Continued)

*Primary Examiner* — Topaz L. Elliott
*Assistant Examiner* — Jason G Davis
(74) *Attorney, Agent, or Firm* — Eileen Pape

(57) ABSTRACT

A contra-rotating compressor includes a first shaft assembly disposed in a housing, the first shaft assembly including an outer shaft, and a first plurality of impellers coupled to the outer shaft, wherein the outer shaft includes a final stage that includes a final impeller of the first plurality of impellers, a second shaft assembly disposed in the housing and rotatable about the longitudinal axis, the second shaft assembly including a second plurality of impellers, a first pair of annular seals between the final stage and an inner surface of the housing, the pair of annular seals being configured to permit relative rotation between the final stage and the housing, and a third annular seal positioned between the outer surface of the final stage and an inner surface of the second shaft assembly, the third annular seal configured to permit contra-rotation between the final stage and the second shaft assembly.

5 Claims, 10 Drawing Sheets

Related U.S. Application Data

(60) Provisional application No. 62/725,597, filed on Aug. 31, 2018.

(58) Field of Classification Search
CPC .... F04D 29/0413; F04D 29/10; F04D 29/106; F04D 29/181; F04D 29/185; F04D 29/662; F04D 31/00; F02C 3/067
See application file for complete search history.

(56) References Cited

U.S. PATENT DOCUMENTS

| | | | |
|---|---|---|---|
| 9,476,427 | B2 | 10/2016 | Torkildsen et al. |
| 2009/0155079 | A1 | 6/2009 | Suciu et al. |
| 2015/0377358 | A1 | 12/2015 | Groette et al. |
| 2017/0130730 | A1 | 5/2017 | Torkildsen |

OTHER PUBLICATIONS

Extended European Search Report dated Jan. 27, 2020, for Application No. EP19194533.6, 11 pages.

* cited by examiner

THRUST-BALANCING WET GAS COMPRESSOR

CROSS-REFERENCE TO RELATED APPLICATIONS

The present application claims benefit of U.S. provisional patent application No. 62/725,597 filed Aug. 31, 2018, and entitled "Subsea Compressors with Adjusted Thrust Impellers", which is incorporated herein by reference in its entirety.

STATEMENT REGARDING FEDERALLY SPONSORED RESEARCH OR DEVELOPMENT

Not applicable.

BACKGROUND

Conventional turbo compressors are typically designed to compress a gas. They are normally composed of many stages (rotating impellers and static diffusers) stacked on a flexible shaft rotating at relative high speed. Critical mechanical elements such as bearings and thrust-balancing devices are often exposed to the process fluid. Any impurities in the process fluid such as solids or liquid may be detrimental to both the thermodynamic and mechanical performance of the compressor. When impurities or liquid are expected to be present in the process stream different types of auxiliary equipment may be utilized to clean or dry the process gas upstream the compressor.

Attempts to modify conventional turbo compressors to be so called "liquid tolerant" have sometimes had limited success and only very low liquid volume fractions can be accepted in some cases. However, even in these cases the presence of liquid may cause deterioration in the thermodynamic and mechanical performance. The challenges are even greater when designing a gas compressor for use in a subsea environment. In an attempt to address at least some of these limitations, contra-rotating compressors have been developed that include a first plurality of impellers rotating about a longitudinal axis in a first direction, and a second plurality of impellers interleaved with the first plurality and rotating about the longitudinal axis in a second direction.

SUMMARY

An embodiment of a contra-rotating compressor for compressing a process fluid comprises a first shaft assembly disposed in a housing and rotatable about a longitudinal axis, the first shaft assembly comprising an outer shaft, and a first plurality of impellers coupled to the outer shaft, wherein the outer shaft comprises a final stage that includes a final impeller of the first plurality of impellers, a second shaft assembly disposed in the housing and rotatable about the longitudinal axis, the second shaft assembly comprising a second plurality of impellers interleaved with the first plurality of impellers, a first pair of annular seals between the final stage and an inner surface of the housing, the pair of annular seals being configured to permit relative rotation between the final stage and the housing, and a third annular seal positioned between the outer surface of the final stage and an inner surface of the second shaft assembly, the third annular seal configured to permit contra-rotation between the final stage and the second shaft assembly. In some embodiments, the final stage comprises an inner cylindrical member, an outer cylindrical member comprising an outlet port, an annular shoulder extending between the inner cylindrical member and the outer cylindrical member, and an annular channel formed between the inner cylindrical member and the outer cylindrical member and terminating the annular shoulder, wherein the final impeller is positioned in the annular channel. In some embodiments, a radially inner end of the final impeller is coupled to the inner cylindrical member of the final stage and a radially outer end of the final impeller is permitted to flex relative to the outer cylindrical member of the final stage. In certain embodiments, the compressor further comprises a pressure balancing circuit configured to be in fluid communication with an inlet flow of the process fluid at an inlet pressure, wherein the pressure balancing circuit comprises a chamber positioned axially between the final stage and the lower shaft assembly. In certain embodiments, the pressure balancing circuit further comprises a first passage extending through the housing, and a second passage extending through the final stage. In some embodiments, the compressor further comprises a pressure balancing circuit configured to be in fluid communication with an inlet flow of the process fluid at an inlet pressure, wherein the pressure balancing circuit comprises a first passage extending through a cylindrical member of the final stage, a second passage extending through the final impeller, and a chamber positioned axially between the final stage and the lower shaft assembly. In some embodiments, the compressor further comprises a pressure balancing circuit configured to be in fluid communication with an inlet flow of the process fluid at an inlet pressure, wherein the pressure balancing circuit comprises a first passage extending through a cylindrical member of the final stage, a second passage extending through the lower shaft assembly, and a chamber positioned axially between the final stage and the lower shaft assembly. In certain embodiments, the compressor further comprises a barrier fluid system that comprises a first barrier fluid seal assembly positioned around the upper shaft assembly and configured to receive a barrier fluid at a first pressure, a second barrier fluid seal assembly positioned around the lower shaft assembly and configured to receive the barrier fluid at the first pressure.

An embodiment of a contra-rotating compressor for compressing a process fluid comprises a housing configured to receive an inlet flow of the process fluid at an inlet pressure and output an outlet flow of the process fluid at an outlet pressure, a first shaft assembly disposed in the housing and rotatable about a longitudinal axis, the first shaft assembly comprising an outer shaft, and a first plurality of impellers coupled to the outer shaft, wherein the outer shaft comprises a final stage that includes a final impeller of the first plurality of impellers, a second shaft assembly disposed in the housing and rotatable about the longitudinal axis, the second shaft assembly comprising a second plurality of impellers interleaved with the first plurality of impellers, and a chamber positioned axially between the final stage and the lower shaft assembly, wherein the chamber is configured to be in fluid communication with the inlet flow of the process fluid at the inlet pressure. In some embodiments, the compressor further comprises a pressure balancing circuit that includes the chamber, wherein the pressure balancing circuit comprises a first passage extending through a cylindrical member of the final stage, and a second passage extending through the final impeller. In some embodiments, the compressor further comprises a pressure balancing circuit that includes the chamber, wherein the pressure balancing circuit comprises a first passage extending through a cylindrical member of the final stage, and a second passage extending through the lower shaft assembly. In certain embodiments, the compressor further comprises a first pair of annular seals between the final stage and an inner surface of the housing, the pair of annular seals being configured to permit relative rotation between the final stage and the housing, and a third annular seal positioned between the outer surface of the final stage and an inner surface of the second shaft assembly, the third annular seal configured to permit contra-rotation between the final stage and the second shaft assembly. In certain embodiments, the final stage comprises an inner cylindrical member, an outer cylindrical member comprising an outlet port, an annular shoulder extending between the inner cylindrical member and the outer cylindrical member, and an annular channel formed between the inner cylindrical member and the outer cylindrical member and terminating the annular shoulder, wherein the final impeller is positioned in the annular channel. In certain embodiments, the compressor further comprises a barrier fluid system that comprises a first barrier fluid seal assembly positioned around the upper shaft assembly and configured to receive a barrier fluid at a first pressure, a second barrier fluid seal assembly positioned around the lower shaft assembly and configured to receive the barrier fluid at the first pressure. In certain embodiments, the second plurality of impellers are positioned axially between the first barrier fluid seal assembly and the second barrier fluid seal assembly.

An embodiment of a method for compressing a process fluid comprises (a) flowing an inlet flow of the process fluid into a housing at an inlet pressure, (b) rotating a first shaft assembly disposed in the housing and comprising a first plurality of impellers about a longitudinal axis in a first rotational direction, (c) rotating a second shaft assembly disposed in the housing and comprising a second plurality of impellers interleaved with the first plurality of impellers about the longitudinal axis in a second rotational direction opposite the first rotational direction, and (d) applying an axially directed pressure force to each end of the lower shaft assembly with the process fluid at the inlet pressure. In some embodiments, (d) comprises (d1) communicating the process fluid at the inlet pressure to a chamber positioned axially between the upper shaft assembly and the lower shaft assembly. In some embodiments, (d) comprises (d2) communicating the process fluid at the inlet pressure through a passage extending through at least one of the first plurality of impellers. In certain embodiments, (d) comprises (d2) communicating the process fluid at the inlet pressure through a passage extending through the lower shaft assembly. In certain embodiments, the method further comprises (e) flowing an outlet flow of the process fluid from the housing at an outlet pressure, (f) leaking a portion of the outlet flow into the chamber, and (g) recirculating the leaked portion of the outlet flow to the inlet flow.

BRIEF DESCRIPTION OF THE DRAWINGS

For a detailed description of exemplary embodiments, reference will now be made to the accompanying drawings in which.

DETAILED DESCRIPTION

Figure 1:
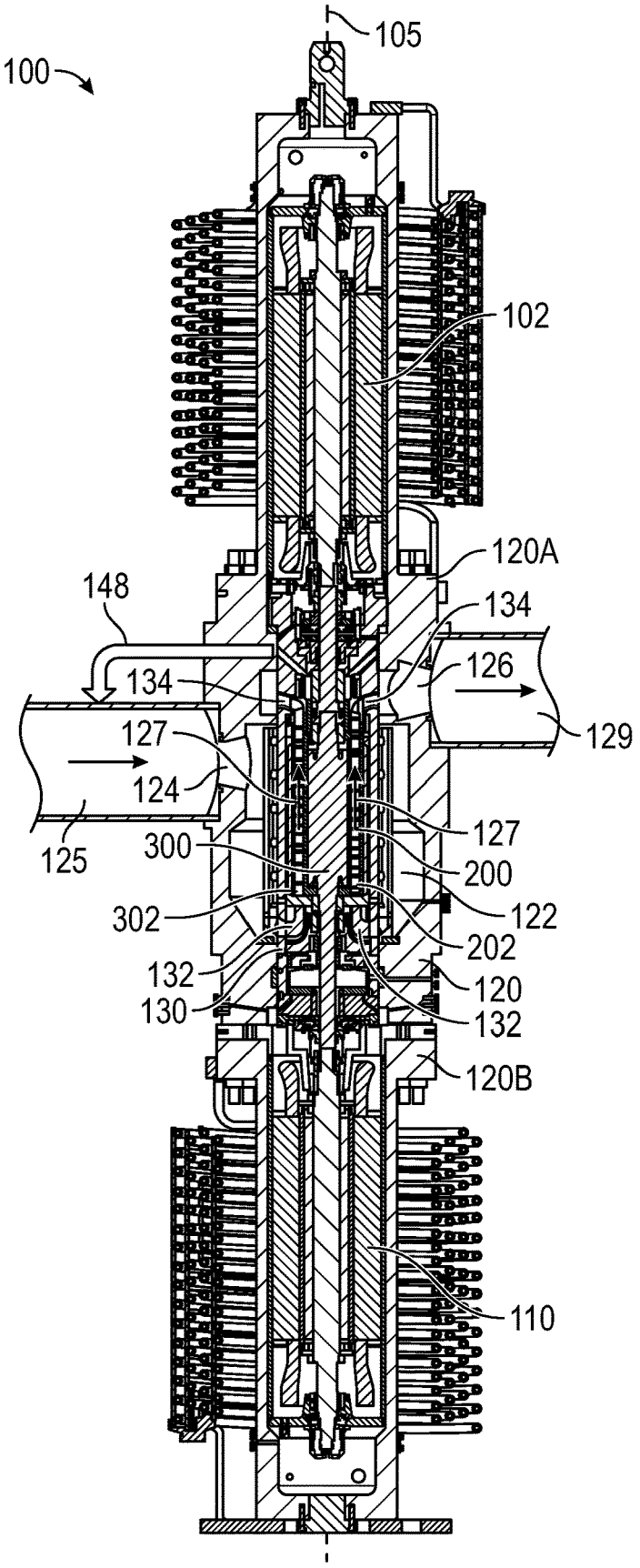
FIG. 1 is a schematic view of an embodiment of a contra-rotating compressor assembly in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, an embodiment of a contra-rotating axial turbo compressor assembly 100 is shown. In the embodiment of FIG. 1, compressor assembly 100 is configured for processing multiphase, gas-liquid and wet gasses in a subsea environment. Compressor assembly 100 has a central or longitudinal axis 105 and generally includes a first or upper motor 102, a second or lower motor 110, a generally cylindrical compressor outer housing 120 positioned between motors 102, 110, a first or upper shaft assembly 200 rotatably disposed in outer housing 120, and a second or lower shaft assembly 300 also rotatably disposed in outer housing 120. Shaft assemblies 200, 300 of compressor assembly 100 extend concentrically through outer housing 120. Upper shaft assembly 200 is rotatably coupled with upper motor 102 such that upper motor 102 may transmit torque and rotate upper shaft assembly 200 within outer housing 120 while lower shaft assembly 300 is rotatably coupled with lower motor 110 such that lower motor 110 may transmit torque and rotate lower shaft assembly 300 within outer housing 120. Although in this embodiment upper shaft assembly 200 is rotatably coupled with upper motor 102 and lower shaft assembly 300 is rotatably coupled with lower motor 110, in other embodiments upper shaft assembly 200 may be rotatably coupled with lower motor 110 and lower shaft assembly 300 may be rotatably coupled with upper motor 102.

In this embodiment, outer housing 120 of compressor assembly has a first or upper end 120A, a second or lower end 120B opposite upper end 120A, and a central passage 122 extending between ends 120A, 120B. Additionally, outer housing 120 includes a first or inlet port 124 extending radially between central passage 122 and an exterior of outer housing 120, and a second or outlet port 126 extending radially between central passage 122 and the exterior of outer housing 120. In this embodiment, compressor assembly 100 includes a generally cylindrical compressor inner housing 130 positioned in the central passage 122 of outer housing 120. Inner housing 130 includes a plurality of circumferentially spaced fluid inlets 132 proximal a lower end of inner housing 130 and a plurality of circumferentially spaced fluid outlets 134 proximal an upper end of inner housing 130. Upper shaft assembly 200 and lower shaft assembly 300 of compressor assembly 100 each extend through a central passage of inner housing 130. Upper shaft assembly 200 includes a plurality of blades or impellers 202 mounted and arranged on an interior thereof while lower shaft assembly 300 includes a corresponding plurality of blades or impellers 302 mounted on an exterior thereof and interleaved with impellers 202 of upper shaft assembly 200. In this embodiment, the interleaved impellers 202, 302 of shaft assemblies 200, 300, respectively, are arranged so as to intermesh through alternating stages or rows of impellers, with each two adjacent rows of impellers rotating in opposite directions. Thus, each row of impellers 202, 302 forms a separate stage of compressor assembly 100. Instead of relying on guide vanes or diffusers between the successive adjacent stages, the process fluid discharged from a stage rotating in one direction immediately enters into the stage rotating in the opposite direction and so on through a number of successive contra rotating stages of compressor assembly 100.

During operation of compressor assembly 100, upper shaft assembly 200 and lower shaft assembly 300 contra-rotate about central axis 105 by motors 102, 110, respectively. An inlet fluid flow (indicated by arrow 125) of process fluid at an inlet fluid pressure flows into the central passage 122 of outer housing 120 via inlet port 124. The process fluid flow then flows through the fluid inlets 132 of inner housing 130 and is urged in an upwards direction (indicated by arrows 127) by the contra-rotation of shaft assemblies 200, 300. Particularly, upper motor 102 rotates upper shaft assembly 200 in a first rotational direction about central axis 105. The rotation of upper shaft assembly 200 in the first rotational direction causes impellers 202 to exert a force on the process fluid in upwards direction 127, which is primarily parallel to central axis 105. Additionally, lower motor 110 rotates lower shaft assembly 300 in a second rotational direction, opposite the first rotational direction, about central axis 105. The rotation of lower shaft assembly causes impellers 302 to exert a force on the process fluid in the same upwards direction 127 as the force imparted on the process fluid by impellers 202 of upper shaft assembly 200. As the process fluid flows upward it is pressurized by the action of the contra-rotating impellers 202, 302 of shaft assemblies 200, 300, respectively, until exiting inner housing 130 via fluid outlets 134. From fluid outlets 134, the process fluid flow exits the central passage 122 of outer housing 120 via outlet port 126 as an outlet fluid flow (indicated by arrow 129) at an outlet fluid pressure that is greater than the inlet pressure.

Figure 2:
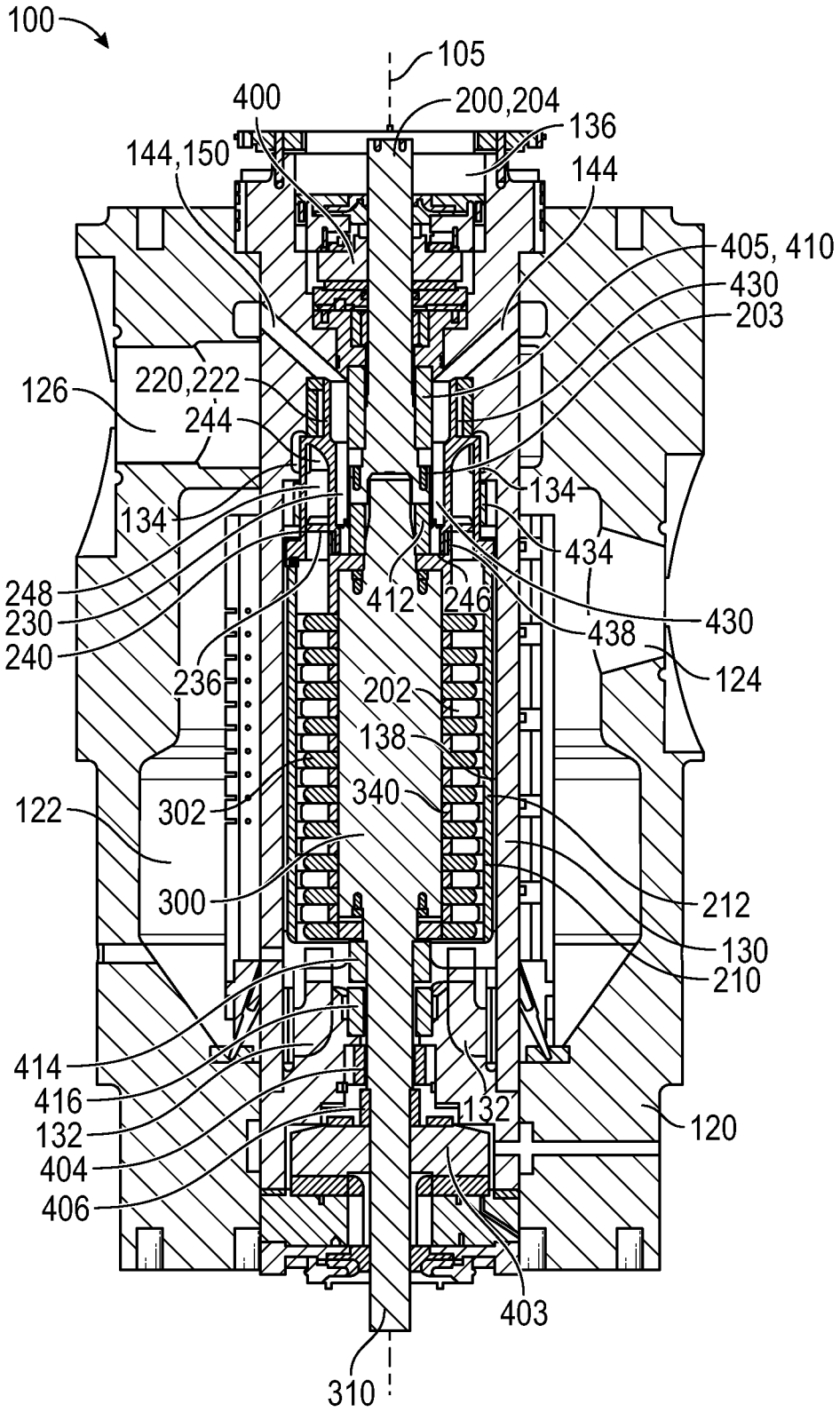
FIGS. 2, 3 are side cross-sectional views of the compressor assembly of FIG. 1.
Figure 3:
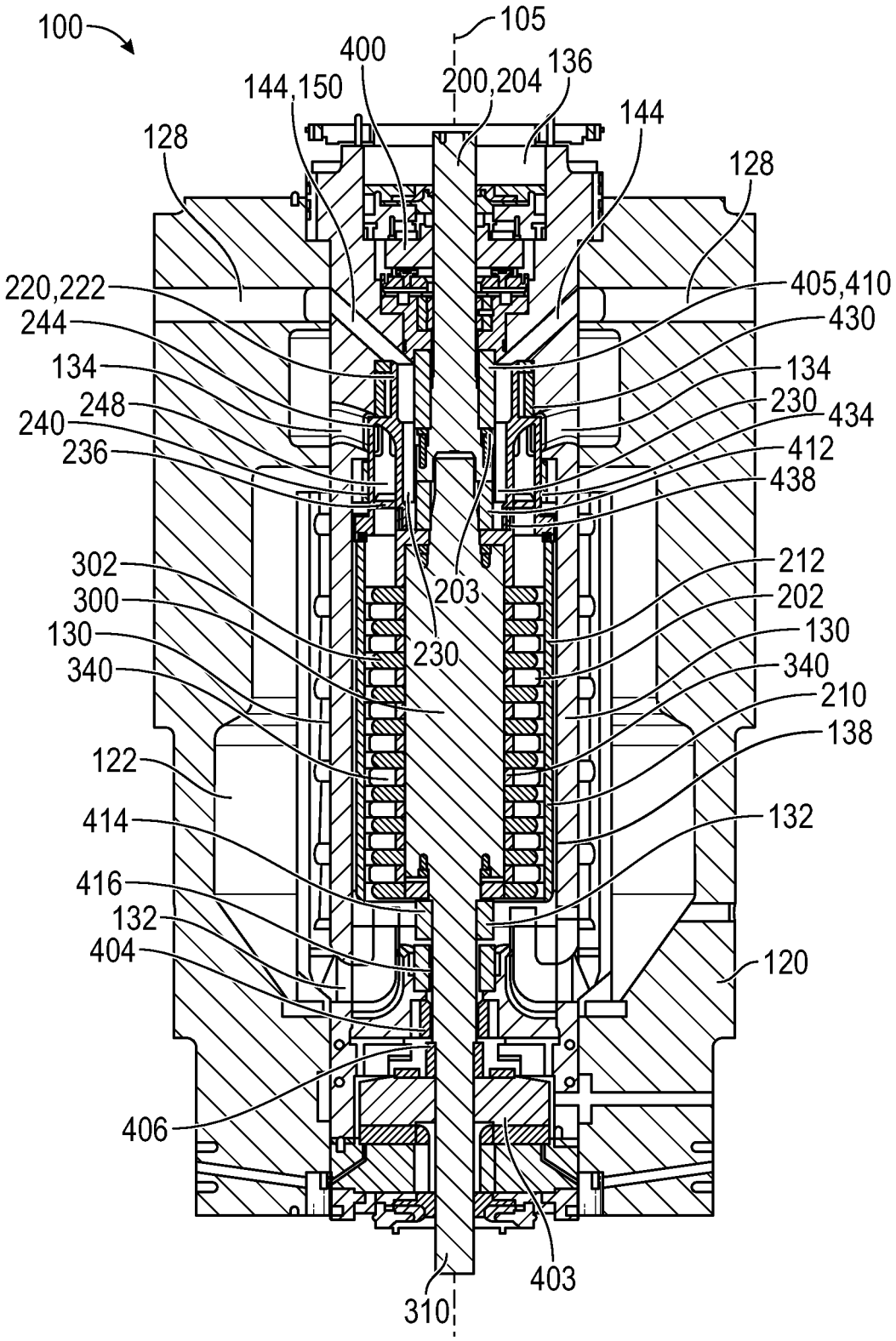
Figure 4:
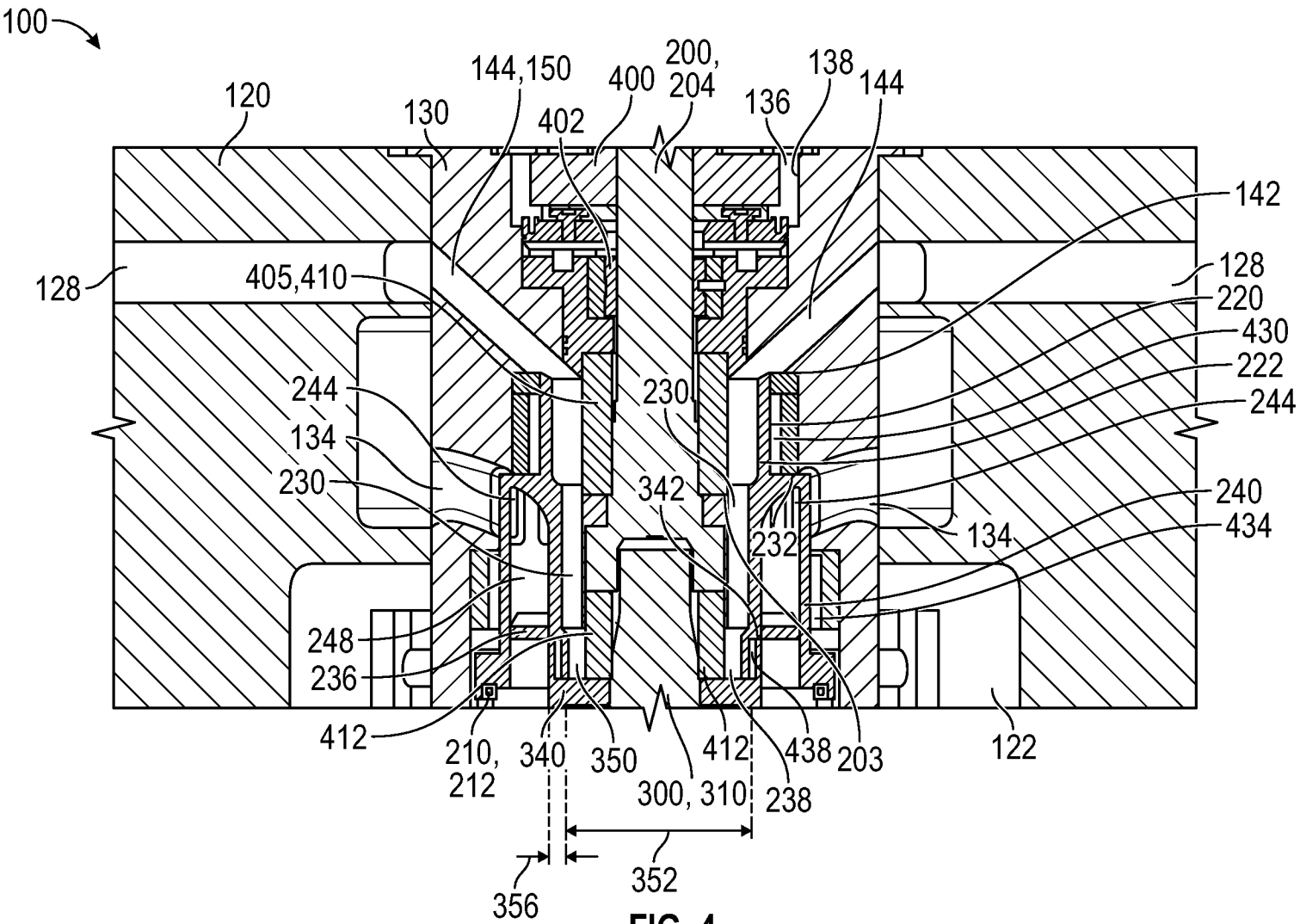
FIG. 4 is a zoomed-in, side cross-sectional view of the compressor assembly of FIG. 1.
Figure 5:
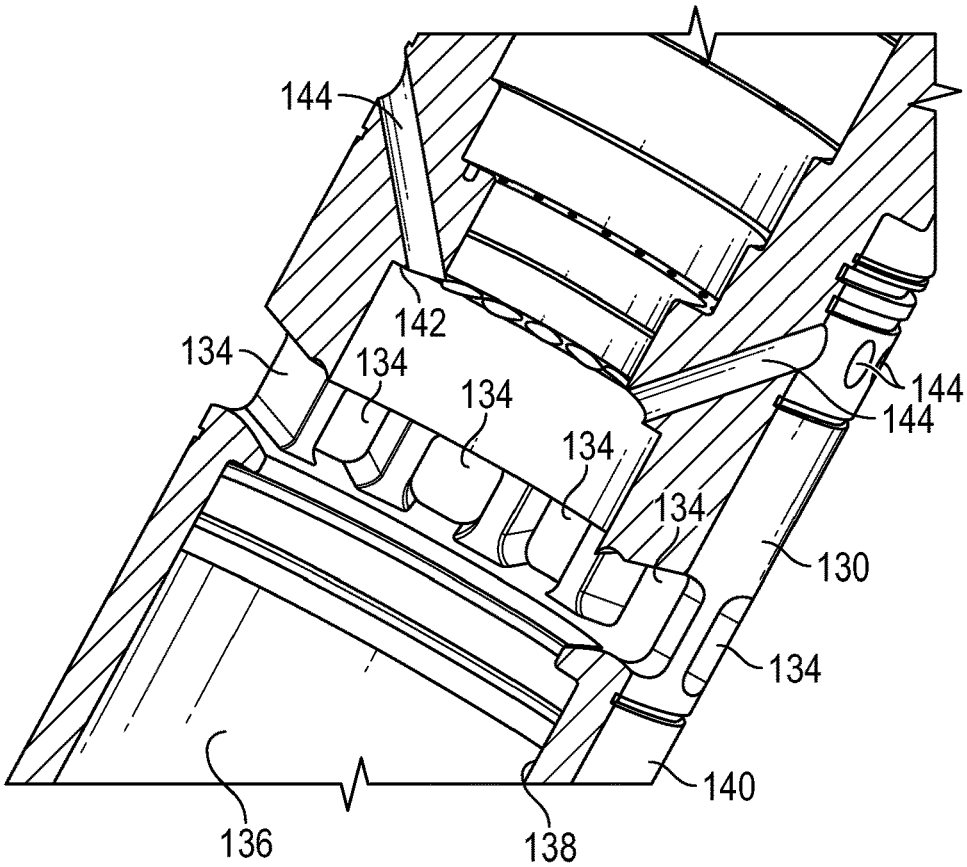
FIG. 5 is a perspective cross-sectional view of an embodiment of an inner housing of the compressor assembly of FIG. 1 in accordance with principles disclosed herein.
Figure 6:
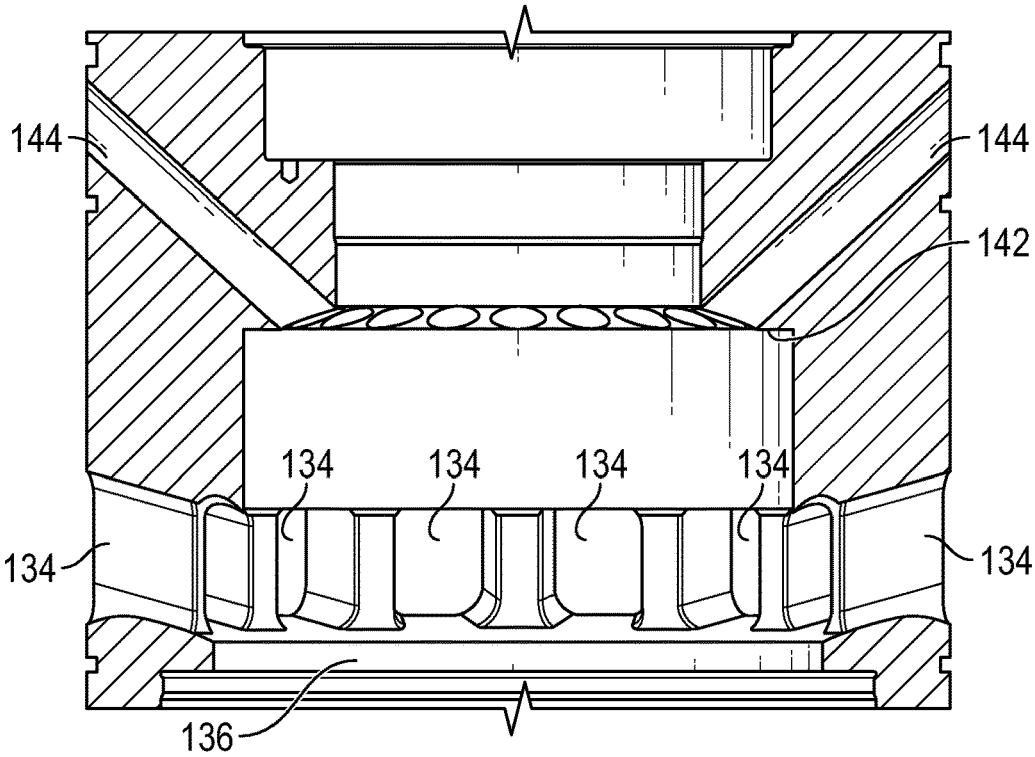
FIG. 6 is a side cross-sectional view of the inner housing of FIG. 5.

Referring to FIGS. 1-6, cross-sectional views of the outer housing 120, inner housing 130, and shaft assemblies 200, 300 of compressor assembly are shown in greater detail in FIGS. 2-4 (the side cross-sectional view of FIG. 3 is rotated approximately 90° from the side cross-sectional view shown in FIG. 2), and the inner housing 130 of compressor assembly 100 is shown in greater detail in FIGS. 5, 6. As shown particularly in FIGS. 5, 6, inner housing 130 of compressor assembly 100 includes a central bore or passage 136 defined by a generally cylindrical inner surface 138, and a generally cylindrical outer surface 140. The previously described fluid inlets 132 and fluid outlets 134 of inner housing 130 each extend radially between inner surface 138 and outer surface 140. In the embodiment of FIGS. 1-6, the inner surface 138 of inner housing 130 includes an annular shoulder 142, where a plurality of circumferentially spaced pressure balancing passages 144 extend between shoulder 142 and the outer surface 140 of inner housing 130. Pressure balancing passages 144 of inner housing 130 are in fluid communication with a plurality of circumferentially spaced pressure balancing passages 128 (shown in FIG. 4) formed in outer housing 120. Each pressure balancing passage 128 of outer housing 120 extends to an exterior of compressor assembly 100. As will be discussed further herein, in this embodiment, a pressure balancing conduit 148 (shown in FIG. 1) provides fluid communication between pressure balancing passages 144, 128 of housings 130, 120, respectively, and the inlet fluid flow 125.

In this embodiment, upper shaft assembly 200 of compressor assembly 100 generally includes a cylindrical inner shaft 204 coupled to an annular outer shaft 210. Outer shaft 210 includes a generally cylindrical drum 212 having an inner surface on which impellers 202 of upper shaft assembly 200 are arranged, and an upper or final stage 220 coupled to an upper end of drum 212. Inner shaft 204 extends from an upper end coupled to upper motor 102 to a lower end coupled to the final stage 220 of outer shaft 210 at an annular interface 203 formed therebetween. In this embodiment, the lower end of inner shaft 204 is coupled to the final stage 220 of outer shaft 210 (e.g., via welding, fasteners, etc.); however, in other embodiments, inner shaft 204 and outer shaft 210 of upper shaft assembly 200 may comprise a single, monolithically formed member.

Figure 7:
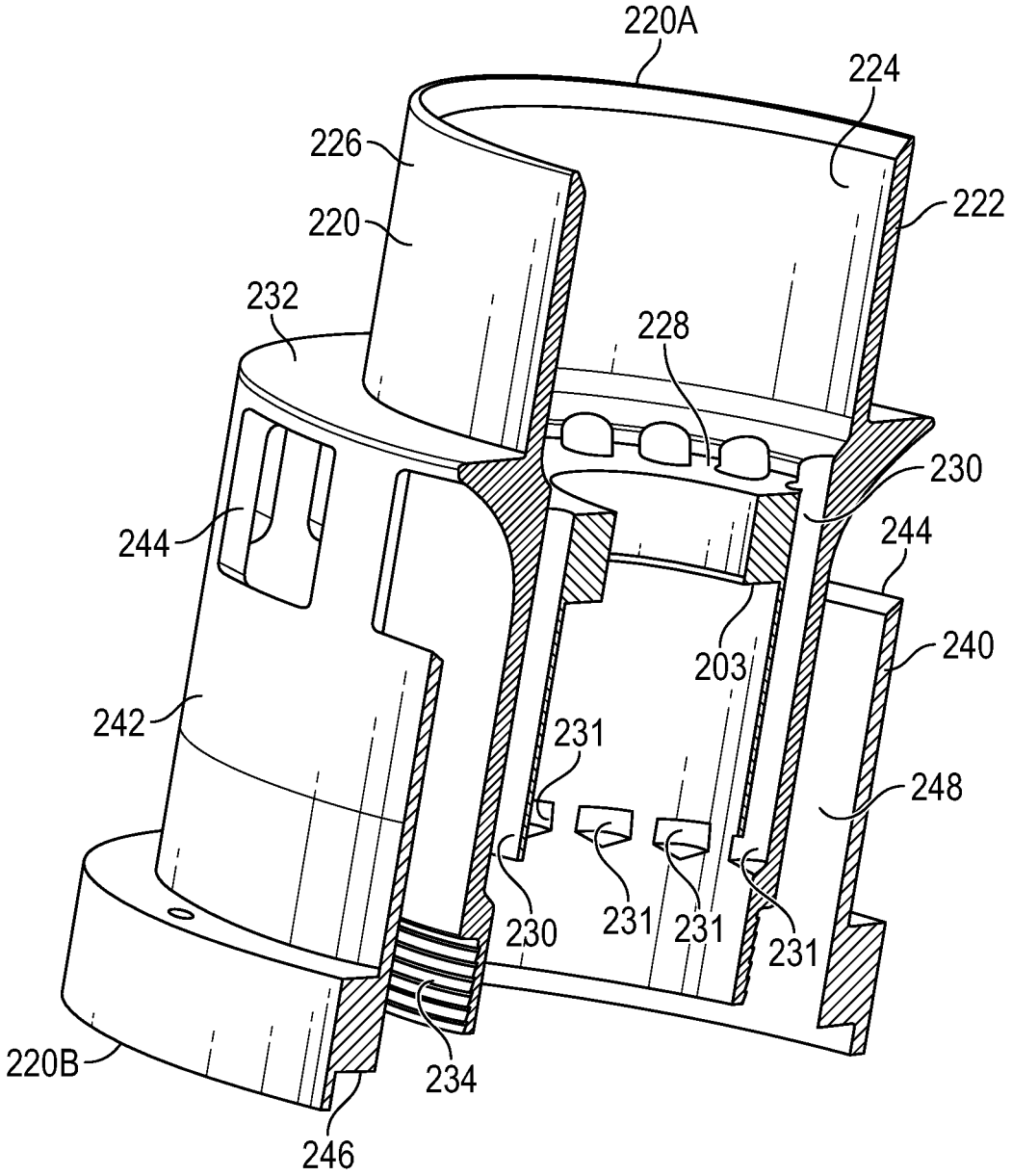
FIG. 7 is a perspective cross-sectional view of an embodiment of a final stage of the compressor assembly of FIG. 1 in accordance with principles disclosed herein.
Figure 8:
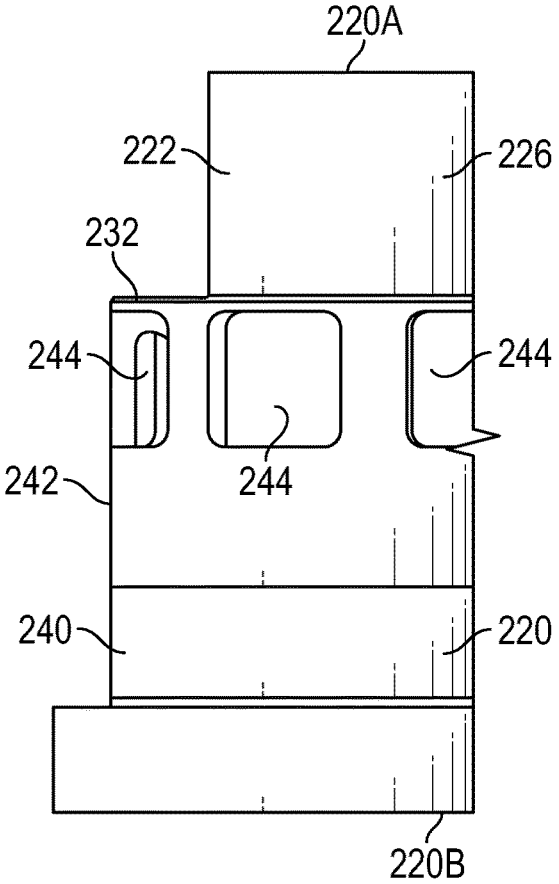
FIGS. 8, 9 are side cross-sectional views of the final stage of FIG. 7.
Figure 9:
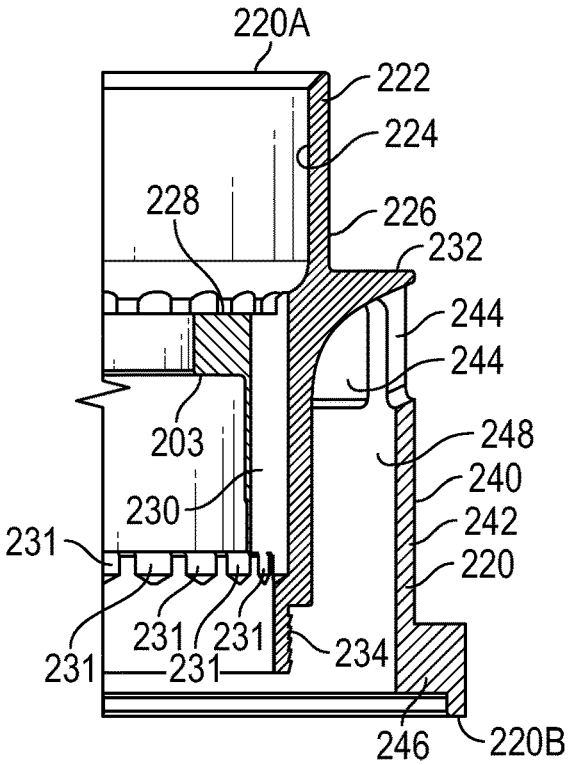

Referring to FIGS. 1-9, final stage 220 of the outer shaft 210 of upper shaft assembly 200 is shown in greater detail in FIGS. 7-9. In the embodiment of FIGS. 1-9, final stage 220 has a first or upper end 220A, a second or lower end 220B opposite upper end 220A, an inner cylindrical member 222 extending from upper end 220A, and an outer cylindrical member 240 extending from lower end 220B.

Inner cylindrical member 222 of final stage 220 includes a generally cylindrical inner surface 224 and a generally cylindrical outer surface 226. The inner surface 224 of inner cylindrical member 222 includes an annular shoulder 228 that includes a plurality of circumferentially spaced pressure balancing passages 230. Particularly, each pressure balancing passage 230 extend from shoulder 228 to an opening 231 spaced from shoulder 228 and formed in the inner surface 224 of inner cylindrical member 222. As will be discussed further herein, pressure balancing passages 230 of inner cylindrical member 222 are in fluid communication with the pressure balancing passages 144, 128 of housings 130, 120, respectively.

The outer surface 226 of inner cylindrical member 222 includes an annular shoulder or bridge 232 that connects inner cylindrical member 222 with an upper end of the outer cylindrical member 240 of final stage 220. Bridge 232 encloses the cylindrical members 222, 240 of final stage 220, and thus, final stage 220 comprises an enclosed final stage 220. In this embodiment, the outer surface 226 of inner cylindrical member 222 includes a connector 234 for coupling with a final stage impeller 236 (shown in FIG. 4) of outer shaft 210 which, in the interest of clarity, is hidden in FIGS. 5-7. Although in this embodiment final stage impeller 236 is coupled to inner cylindrical member 222 via connector 234, in other embodiments, final stage impeller 236 may be formed monolithically with inner cylindrical member 222.

The outer cylindrical member 240 of final stage 220 includes a plurality of circumferentially spaced radial ports 244 proximal an upper end of outer cylindrical member 240 and an annular interface 246 configured to couple to an upper end of the drum 212 of outer shaft 210. Given that final stage 220 comprises an enclosed final stage 220, outer cylindrical member 240 includes ports 244 for directing the outlet fluid flow 129 towards the fluid outlets 134 of inner cylinder 130. In this embodiment, an annular channel 248 is formed between inner cylindrical member 222 and outer cylindrical member 240 of final stage 220. During operation of compressor assembly 100, the outlet fluid flow 129 shown in FIG. 1 passes through annular channel 248 and flows through radial ports 244 of final stage 220 prior to flowing through fluid outlets 134 of inner housing 130 and exiting compressor assembly 100 via outlet port 126 of outer housing 120.

As shown particularly in FIG. 4, compressor assembly 100 includes a first or upper thrust bearing 400 which is positioned in the central passage 136 of inner housing 130 and engages a cylindrical outer surface of the inner shaft 204 of upper shaft assembly 200 to absorb axially directed thrust loads applied to upper shaft assembly 200. Additionally, compressor assembly 100 includes a first or upper radial bearing 402 which engages the outer surface of inner shaft 204 proximal upper thrust bearing 400 to support relative rotation between inner shaft 204 and inner housing 130. In this embodiment, a plurality of barrier fluid passages extend through inner shaft 202 of upper shaft assembly 200 to a lower end thereof. As will be described further herein, the barrier fluid passages of inner shaft 204 are in fluid communication with a barrier fluid system 405 of compressor assembly 100 configured to supply a pressurized barrier fluid (via, e.g., a barrier fluid pump and an associated controller) that is distinct from the process fluid to components of compressor assembly 100, including a first or upper barrier fluid seal assembly 410 positioned radially between inner shaft 204 and the inner cylindrical member 222 of the final stage 220 of outer shaft 210. Upper barrier fluid seal assembly 410 assists in ensuring fluid disposed in pressure balancing passages 128, 144, and 230 (collectively comprising a pressure balancing circuit 150 of compressor assembly 100) is isolated from other portions of compressor assembly 100.

As shown particularly in FIGS. 2-4, in this embodiment, the lower shaft assembly 300 of compressor assembly 100 generally includes a generally cylindrical inner shaft 310 and an annular outer shaft or drum 340 disposed about and coupled to an outer surface of inner shaft 310. Drum 340 includes an outer surface on which impellers 302 of lower shaft assembly 300 are arranged. Although in this embodiment lower shaft assembly 300 comprises a distinct inner shaft 310 and drum 340, in other embodiments, inner shaft 310 and drum 340 may comprise a single, monolithically formed member.

In this embodiment, an upper end of the inner shaft 310 of lower shaft assembly 300 includes a plurality of barrier fluid passages which are in fluid communication with the barrier fluid passages of upper shaft assembly 200. An annular contra-rotating bearing is positioned between the inner shaft 310 of lower shaft assembly 300 and the inner shaft 204 of upper shaft assembly 200 to permit contra-rotation therebetween. The barrier fluid passages of lower shaft assembly 300 are configured to supply barrier fluid of barrier fluid system 405 to a second or intermediate barrier fluid seal assembly 412 comprising a contra-rotating seal configured to seal the annular interface formed between inner shaft 310 of the lower shaft assembly 300 and the inner cylindrical member 222 of the final stage 220 of upper shaft assembly 200. Like the upper barrier fluid seal assembly 410 of barrier fluid system 405, intermediate barrier fluid seal assembly 412 assists in ensuring fluid disposed in pressure balancing circuit 150 is isolated from other portions of compressor assembly 100.

Compressor assembly 100 additionally includes a second or lower thrust bearing 403 positioned in the central passage 122 of outer housing 120 that engages a cylindrical outer surface of the inner shaft 310 of lower shaft assembly 300 to absorb axially directed thrust loads applied to lower shaft assembly 300. In this embodiment, compressor assembly 100 further includes a second or intermediate radial bearing 404 and a third or lower radial bearing 406, each positioned in the central passage 136 of inner housing 130. Intermediate radial bearing 404 engages the outer surface of the outer shaft 210 of upper shaft assembly 200 proximal a lower end thereof to support relative rotation between outer shaft 210 and inner housing 130. Lower radial bearing 406 engages an outer surface of the inner shaft 310 of lower shaft assembly 300 to support relative rotation between inner shaft 310 and inner housing 130.

In this embodiment, the barrier fluid system 405 of compressor assembly 100 includes a third or intermediate barrier fluid seal assembly 414 configured to seal the annular interface formed between the inner shaft 310 of lower shaft assembly 300 and the outer shaft 210 of upper shaft assembly 200. Intermediate barrier fluid seal assembly 414 comprises a contra-rotating seal and is supplied with pressurized barrier fluid via the barrier fluid passages formed in inner shaft 310. Barrier fluid system 405 further includes a fourth or lower barrier fluid seal assembly 416 is configured to seal the annual interface formed between a lower end of the outer shaft 210 of upper shaft assembly 200 and the inner surface 138 of inner housing 130. Lower barrier fluid seal assembly 416 is supplied with barrier fluid from barrier fluid system 405 via passages formed in the inner housing 130 (not shown in FIGS. 2-4).

As shown particularly in FIG. 4, compressor assembly 100 includes an annular first or upper rotating seal assembly 430 positioned between the inner surface 138 of inner housing 130 and final stage 220. Particularly, upper rotating seal assembly 430 sealingly engages the outer surface 226 of the inner cylindrical member 222 of final stage 220 while permitting relative rotation between final stage 220 and inner housing 130. Compressor assembly 100 additionally includes an annular second or lower rotating seal assembly 434 positioned between the inner surface 138 of inner housing 130 and final stage 220. Lower rotating seal assembly 434 sealingly engages the outer surface 242 of the outer cylindrical member 240 of final stage 220 while permitting relative rotation between final stage 220 and inner housing 130. Further, in this embodiment, compressor assembly 100 includes an annular contra-rotating seal assembly 438 positioned radially between the final stage 220 of upper shaft assembly 200 and lower shaft assembly 300. Particularly, contra-rotating seal assembly 438 sealingly engages the outer surface 226 of the inner cylindrical member 222 of final stage 220 and a generally cylindrical inner surface 342 of the drum 340 of lower shaft assembly 300.

The sealing engagement between final stage 220 and the drum 340 of lower shaft assembly 300 provided by contra-rotating seal assembly 438 forms an annular pressure balancing chamber 238 that is in fluid communication with pressure balancing passages 230 of final stage 220, and thus comprise a portion of the pressure balancing circuit 150 described above. Particularly, pressure balancing chamber 238 extends radially between the inner surface 342 of the drum 340 of lower shaft assembly 300 and an outer surface of the inner shaft 310 of lower shaft assembly 300.

As described above, pressure balancing circuit 150 of compressor assembly 100 is in fluid communication with the inlet fluid flow 125 via pressure balancing conduit 148, and thus, fluid pressure within pressure balancing chamber 238, as well as the pressure balancing passages (e.g., passages 128, 144, 230) of pressure balancing circuit 150 is substantially equal to the inlet pressure of the inlet fluid flow 125, the inlet fluid pressure of inlet fluid flow 125 entering outer housing 120 being substantially less than an outlet fluid pressure of the outlet fluid flow 129 exiting outer housing 120. The inlet fluid pressure disposed in pressure balancing circuit 150 provides a thrust load against portions of lower shaft assembly 300 in a second or downwards direction (generally opposite the axial upwards travel of fluid flow 127). As shown particularly in FIG. 4, the portion of lower shaft assembly 300 exposed to the inlet fluid pressure of pressure balancing circuit 150 comprises a circular, inner axially-projected surface area 350 defined by a diameter 352 that is equal to a diameter of contra-rotating seal assembly 438. During operation of compressor assembly 100, a portion of the outlet fluid flow 129 exiting final stage 220 may bleed or leak across contra-rotating seal 438 and into the pressure balancing chamber 238 of pressure balancing circuit 150.

In this embodiment, pressure balancing circuit 150 is configured to recirculate any outlet fluid bled into pressure balancing chamber 238 into the inlet fluid flow 125 via pressure balancing conduit 148, thereby providing an outlet for the high pressure outlet fluid. Given that inlet fluid pressure applies a pressure force against lower shaft assembly 300 in the upwards direction 127, the downwards pressure force applied to the inner axially-projected surface area 350 of lower shaft assembly 300 by the inlet fluid pressure does not produce a net thrust load on lower shaft assembly 300. In other words, the downwards thrust load applied to the inner axially-projected surface area 350 of lower shaft assembly 300 is balanced by the upwards thrust load applied to a corresponding inner axially-projected surface area located near a lower end of the lower shaft assembly 300. In this manner, lower shaft assembly 300 of compressor assembly 100 comprises a thrust-balanced lower shaft assembly 300.

Particularly, without the sealing engagement provided by contra-rotating seal assembly 348, the inner axially-projected surface area 350 of lower shaft assembly 300 would be exposed to the outlet fluid pressure of the outlet fluid flow 129 exiting the final stage 220 of upper shaft assembly 200, and thus, the thrust loads imparted to lower shaft assembly 300 would be increased. Therefore, by exposing inner axially-projected surface area 350 of lower shaft assembly 300 to the inlet fluid pressure rather than the greater outlet fluid pressure, contra-rotating seal assembly 438 reduces the total thrust load imparted to lower shaft assembly 300 in the downwards direction by the action of the contra-rotating impellers 202, 302 of shaft assemblies 200, 300, respectively. By reducing the amount of thrust load imparted to lower shaft assembly 300, the differential pressure between the outlet fluid flow 129 and inlet fluid flow 125 achieved by compressor assembly 100 may be increased without jeopardizing the structural integrity of lower shaft assembly 300. Thus, contra-rotating seal 438 is configured to maximize the achievable differential pressure between fluid flows 129, 125, thereby increasing the efficiency of compressor assembly 100.

In this embodiment, while the downwards thrust load applied to lower shaft assembly 300 is reduced by the action of pressure balancing circuit 150 as described above, a reduced net axially directed thrust load in the downwards direction is applied to lower shaft assembly 300 to lower shaft assembly 300 to prevent lower shaft assembly 300 from floating or chattering within outer housing 120 during the operation of compressor assembly 100. Particularly, the net downwards thrust load applied to lower shaft assembly 300 corresponds to an annular outer axially-projected surface area of lower shaft assembly 300 defined by an outer radius 356 extending between contra-rotating seal assembly 438 and an outer cylindrical surface of the drum 340 of lower shaft assembly 300. Thus, the amount of downwards thrust load imparted to lower shaft assembly 300 may be tailored as desired by adjusting the size of outer radius 356.

In this embodiment, compressor assembly 100 is also configured for increasing the maximum differential pressure between fluid flows 125, 129 safely achievable by compressor assembly 100 by distributing thrust loads across the final stage 220 of upper shaft assembly 200. Particularly, torque and thrust loads applied to final stage impeller 236 may be transferred to the inner cylindrical member 222 of final stage 220 via the connection formed therebetween via connector 234. The loads transferred from final stage impeller 236 to inner cylindrical member 222 of final stage 220 may be distributed to outer cylindrical member 240 via the annular bridge 232 coupling outer cylindrical member 240 of final stage 220 with inner cylindrical member 222. In this manner, thrust loads applied to final stage 220 may be shared or distributed between cylindrical members 222, 240, thereby increasing the amount of thrust loads that may be safely applied to final stage 220 without damaging final stage 220.

Further, while a radially inner end of the final stage impeller 236 is connected to the inner cylindrical member 222 of final stage 220, in this embodiment, a radially outer end of final stage impeller 236 is not connected to outer cylindrical member 240. Thus, the radially outer end of the final stage impeller 236 is permitted to flex relative outer cylindrical member 240 and final stage impeller 236, which has a relatively thin cross-sectional area relative cylindrical members 222, 240, is substantially isolated from thrust loads applied to the outer cylindrical member 240 of final stage 220. In this manner, final stage impeller 236 may be at least partially isolated from torque, centrifugal loads, and thrust loads, protecting final stage impeller 236 from damage during the operation of compressor assembly 100. Although in this embodiment final stage impeller 236 is not connected to outer cylindrical member 240 of final stage 220, in other embodiments, final stage impeller 236 may be connected with both inner cylindrical member 222 and outer cylindrical member 240 of final stage 220. For instance, in certain embodiments, cylindrical members 222, 240 and final stage impeller 236 may comprise a single, monolithically formed member.

Beyond reducing the thrust load applied to lower shaft assembly 300, by exposing inner axially-projected surface area 350 of lower shaft assembly 300 to the inlet fluid pressure, pressure balancing conduit 150 of compressor assembly 100 is configured to simply the configuration barrier fluid system 405, thereby reducing the size, weight, cost, and/or complexity of compressor assembly 100. Particularly, barrier fluid system 405 is configured to supply barrier fluid to each barrier fluid seal assembly 410, 412, 414, and 416 at a pressure that is slightly higher than the fluid pressure to which each barrier fluid seal assembly 410, 412, 414, and 416 is exposed such that any leakage across barrier fluid seal assemblies 410, 412, 414, and/or 416 comprises barrier fluid leaking into the process fluid flow (i.e., fluid flows 125, 127, and 129) rather than process fluid leaking into barrier fluid system 405.

In this embodiment, intermediate barrier fluid seal assembly 414 and lower barrier fluid seal assembly 416, each positioned near a lower end of inner housing 130 where the inlet fluid flow 125 enters fluid inlets 132 of inner housing 130, are each exposed to the inlet fluid pressure. Additionally, due to the supply of inlet fluid pressure via pressure balancing circuit 150 and the sealing engagement provided by contra-rotating seal assembly 438, upper barrier fluid seal assembly 410 and intermediate barrier fluid seal assembly 412 are also each exposed to the inlet fluid pressure. Thus, each of the barrier fluid seal assemblies 410, 412, 414, and 416 of barrier fluid system 405 are exposed to the inlet fluid pressure. Given that barrier fluid seal assemblies 410, 412, 414, and 416 are each exposed to substantially the same fluid pressure, the barrier fluid supplied to each of barrier fluid seal assemblies 410, 412, 414, and 416 may be disposed at a single pressure that is slightly greater than the inlet fluid pressure of compressor assembly 100. Therefore, instead of needing to supply barrier fluid at varying pressures (requiring multiple barrier fluid pumps, controllers, etc.), barrier fluid system 405 need only supply a barrier fluid at a single pressure for each of the barrier fluid seal assemblies 410, 412, 414, and 416, thereby simplifying the configuration of the barrier fluid system 405 of compressor assembly 100.

Figure 10:
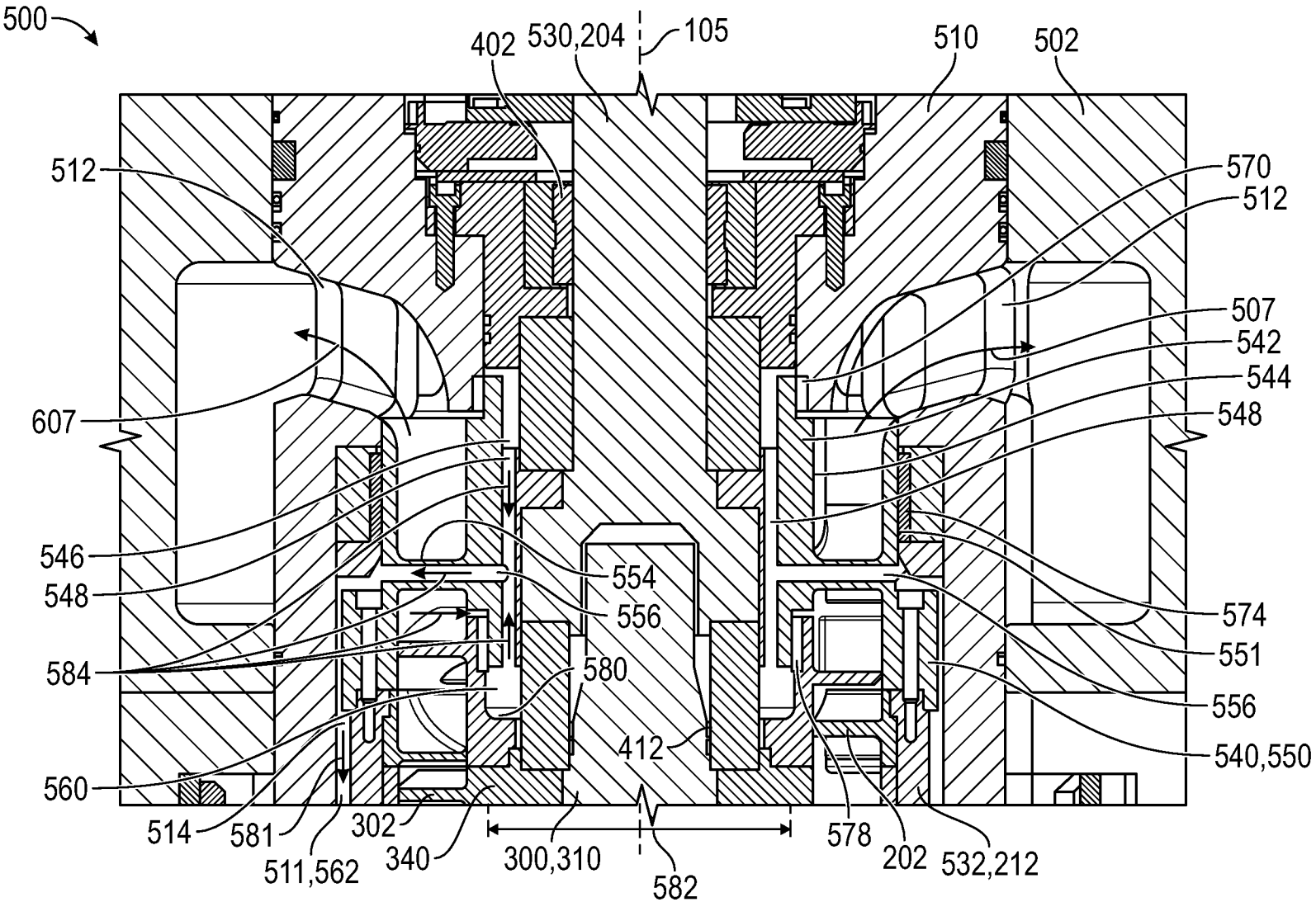
FIG. 10 is a side cross-sectional view of another embodiment of a contra-rotating compressor assembly in accordance with principles disclosed herein.

Although the embodiment shown in FIGS. 1-9 includes an upper shaft assembly 200 comprising an enclosed final stage 220, other embodiments of compressor assemblies including a thrust-balanced lower shaft assembly may employ an open final stage. For example, referring to FIG. 10, an embodiment of a compressor assembly 500 is shown including an upper shaft assembly 530 having an open final stage 540. Compressor assembly 500 of FIG. 10 includes features in common with the compressor assembly 100 shown in FIGS. 1-9, and shared features are labeled similarly. Particularly, in the embodiment of FIG. 10, compressor assembly 500 has a central or longitudinal axis 505 and generally includes an outer housing 502, an inner housing 510 received in a central passage of outer housing 502, first or upper shaft assembly 530, and a second or lower shaft assembly 300' similar in configuration as the lower shaft assembly 300 of compressor assembly 100 and configured to contra-rotate relative upper shaft assembly 530 of compressor assembly 500.

The upper shaft assembly 530 of compressor assembly 500 generally includes inner shaft 204 coupled to an annular outer shaft 532. Outer shaft 532 of upper shaft assembly 530 includes drum 212, and upper or final stage 540 coupled to the upper end of drum 212. In this embodiment, final stage 540 of outer shaft 532 includes an inner cylindrical member 542 extending from an upper end of final stage 540, and an outer cylindrical member 550 extending from a lower end of final stage 540. Unlike the final stage 220 of the compressor assembly 100, final stage 540 of compressor assembly 500 does not include an annular shoulder or bridge connecting the inner cylindrical member 542 with outer cylindrical member 550. Instead, process fluid exits compressor assembly 500 as an outlet fluid flow (indicated by arrows 507 in FIG. 10) via the annular opening formed between an upper end of outer cylindrical member 550 and a generally cylindrical outer surface 544 of the inner cylindrical member 542 of final stage 540. Outlet fluid flow 507 exits compressor assembly 500 via a plurality of circumferentially spaced fluid outlets 512 formed in inner housing 510, and an outlet port (not shown in FIG. 10) formed in outer housing 502.

In this embodiment, the inner cylindrical member 542 of final stage 540 includes an annular shoulder 546 having a plurality of circumferentially spaced pressure balancing passages 548 formed therein, each pressure balancing passage 548 extending to a lower end of inner cylindrical member 542. Final stage 540 additionally includes a final stage impeller 554 extending between inner cylindrical member 542 and outer cylindrical member 550. In this embodiment, final stage impeller 554 is formed monolithically with cylindrical members 542, 550; however, in other embodiments, final stage impeller 554 may be separately coupled with cylindrical members 542, 550. A pressure balancing passage 556 extends through the final stage impeller 554. Pressure balancing passage 556 is in fluid communication with both the pressure balancing passage 548 of inner cylindrical member 540 of final stage 540 and an annular pressure balancing passage 511 formed radially between an outer surface of the drum 212 of upper shaft assembly 530 and a generally cylindrical inner surface 514 of inner housing 510.

Compressor assembly 500 includes an annular first or upper rotating seal assembly 570 positioned radially between the inner surface 514 of inner housing 510 and the outer surface 544 of the inner cylindrical member 542 (proximal an upper end thereof) of final stage 540, and is configured to seal the annular interface formed therebetween. Additionally, compressor assembly 500 includes an annular second or lower rotating seal assembly 574 positioned radially between a generally cylindrical outer surface 551 of the outer cylindrical member 550 of final stage 540 and the inner surface 514 of inner housing 510, and is configured to seal the annular interface formed therebetween. Further, compressor assembly 500 includes an annular contra-rotating seal assembly 578 positioned radially between the outer surface 544 of the inner cylindrical member 542 (proximal a lower end thereof) of final stage 540 and the inner surface 342 of the drum 340 of lower shaft assembly 300'.

The sealing engagement between final stage 540 and the drum 340 of lower shaft assembly 300' provided by contra-rotating seal assembly 578 forms an annular pressure balancing chamber 560 that is in fluid communication with pressure balancing passages 511, 548, and 556. Pressure balancing chamber 560 and pressure balancing passages 511, 548, and 556 collectively comprise a pressure balancing circuit 562 of compressor assembly 500. Pressure balancing passage 511 formed between inner housing 510 and the drum 212 of upper shaft assembly 530 is in fluid communication with the fluid inlets of inner housing 510, and thus the fluid disposed in pressure balancing circuit 562 is disposed at substantially the inlet fluid pressure of the inlet fluid flow entering inner housing 510.

In the configuration described above, a portion of lower shaft assembly 300' is exposed to the inlet fluid pressure of pressure balancing circuit 562, the portion comprising a circular, inner axially-projected surface area 580 defined by a diameter 582 that is equal to a diameter of the contra-rotating seal assembly 578 of compressor assembly 500. Therefore, similar to the operation of the pressure balancing circuit 150 of compressor assembly 100, the pressure balancing circuit 562 of compressor assembly 500 reduces the net downwards thrust load applied to lower shaft assembly 300' by balancing the downwards thrust applied to the inner axially-projected surface area 580 of lower shaft assembly 300' with a corresponding upwards thrust load applied to lower shaft assembly 300' from the inlet fluid pressure exposed to a lower end of lower shaft assembly 300'.

However, unlike compressor assembly 100, compressor assembly 500 thrust-balances lower shaft assembly 300' using a pressure balancing circuit 562 that includes an open final stage 540. In some applications, it may be preferable to employ an open final stage 540, which does not require outlet fluid flow 507 to flow through a plurality of circumferentially spaced ports formed in the final stage. Additionally, instead of recirculating entrained outlet fluid flow that has leaked past seals 570, 574, and/or 578 via passages formed in outer housing 502, outlet fluid flow that has leaked into pressure balancing circuit 562 is recirculated to the fluid inlets of inner housing 510 via pressure balancing passage 511 (indicated by arrows 584).

Figure 11:
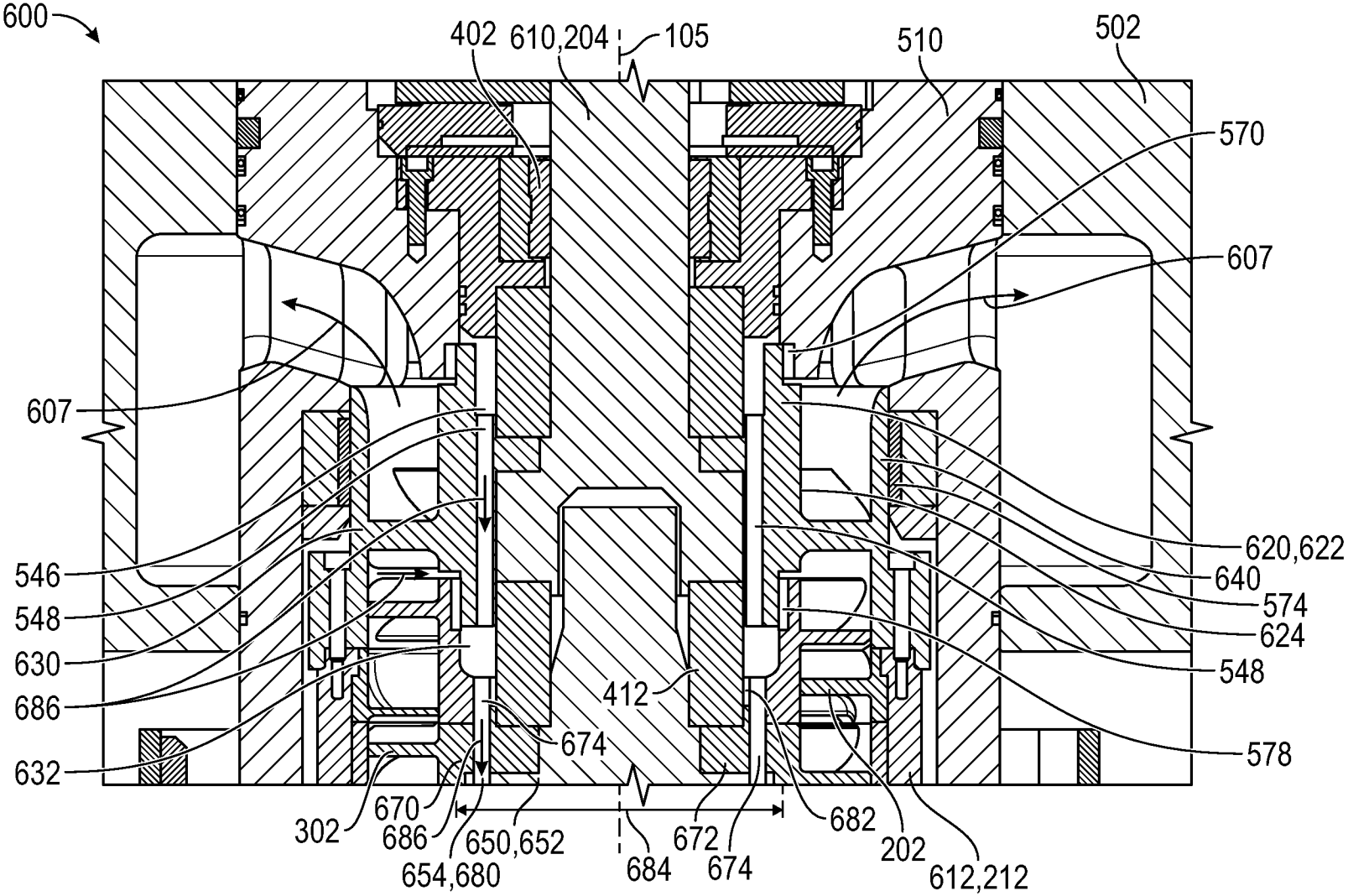
FIG. 11 is a side cross-sectional view of another embodiment of a contra-rotating compressor assembly in accordance with principles disclosed herein.

Referring to FIG. 11, another embodiment of a compressor assembly 600 is shown including an upper shaft assembly 610 having an open final stage 620. Compressor assembly 600 of FIG. 11 includes features in common with the compressor assembly 100 shown in FIGS. 1-9 and the compressor assembly 500 shown in FIG. 10, and shared features are labeled similarly. In the embodiment of FIG. 11, compressor assembly 600 has a central or longitudinal axis 605 and generally includes outer housing 502, inner housing 510, first or upper shaft assembly 610, and a second or lower shaft assembly 650 configured to contra-rotate relative upper shaft assembly 610 of compressor assembly 600.

The upper shaft assembly 610 of compressor assembly 600 generally includes inner shaft 204 coupled to an annular outer shaft 612. Outer shaft 612 of upper shaft assembly 610 includes drum 212, and upper or final stage 620 coupled to the upper end of drum 212. In this embodiment, final stage 620 of outer shaft 612 includes an inner cylindrical member 622 extending from an upper end of final stage 620, and an outer cylindrical member 640 extending from a lower end of final stage 620. Similar to the final stage 540 of the compressor assembly 500 shown in FIG. 10, final stage 620 of compressor assembly 600 does not include an annular shoulder or bridge connecting the inner cylindrical member 622 with outer cylindrical member 640. Thus, process fluid exits compressor assembly 500 as an outlet fluid flow (indicated by arrows 607 in FIG. 11) via the annular opening formed between an upper end of outer cylindrical member 640 and a generally cylindrical outer surface 624 of the inner cylindrical member 622 of final stage 620.

In this embodiment, the inner cylindrical member 622 of final stage 620 includes pressure balancing passages 548 formed therein and a final stage impeller 630 formed monolithically with cylindrical members 620, 640. However, unlike final stage impeller 554 of final stage 540, the final stage impeller 630 of final stage 620 does not include an internal pressure balancing passage for communicating inlet fluid pressure. Additionally, while final stage impeller 630 is formed monolithically with cylindrical members 622, 640, in other embodiments, final stage impeller 630 may be separately coupled with cylindrical members 622, 640.

Lower shaft assembly 650 generally includes a generally cylindrical inner shaft 652 and an annular outer shaft or drum 670 disposed about and coupled to an outer surface of inner shaft 652. Similar to drum 340 of lower shaft assembly 300 shown in FIGS. 2-9, drum 670 of lower shaft assembly 650 includes an outer surface on which impellers 302 are arranged. In this embodiment, the inner shaft 652 of lower shaft assembly 650 includes a plurality of circumferentially spaced pressure balancing passages 654 extending from an upper end thereof, wherein pressure balancing passages 654 are in fluid communication with the fluid inlets (not shown in FIG. 11) of the inner housing 510 of compressor assembly 600.

Drum 670 of lower shaft assembly 650 includes an annular shoulder 672 proximal an upper end of drum 670, where annular shoulder 672 engages the upper end of the inner shaft 652 of lower shaft assembly 650. In this embodiment, drum 670 includes a plurality of circumferentially spaced pressure balancing passages 674, each passage 674 extending axially between upper and lower ends of shoulder 672 and in fluid communication with a corresponding pressure balancing passage 654 of inner shaft 650. Compressor assembly 600 includes rotating seal assemblies 570, 574, and contra-rotating seal assembly 578, thereby defining an annular pressure balancing chamber 632 formed about the inner shaft 652 of lower shaft assembly 650 and extending axially between a lower end of the inner cylindrical member 622 of final stage 620 and the upper end of the annular shoulder 672 of drum 670. Pressure balancing chamber 632 is in fluid communication with pressure balancing passages 548 of final stage 620 and the pressure balancing passages 654, 674 of the inner shaft 652 and drum 670, respectively, of lower shaft assembly 670. Pressure balancing chamber 632 and pressure balancing passages 548, 654, and 674 collectively comprise a pressure balancing circuit 680 of compressor assembly 600. With pressure balancing passages 654 of the inner shaft 652 of lower shaft assembly 650 in fluid communication with the fluid inlets of the inner housing 510, fluid disposed in pressure balancing circuit 680 is disposed at substantially the inlet fluid pressure of the inlet fluid flow entering inner housing 510 of compressor assembly 600.

In the configuration described above, a portion of lower shaft assembly 650 is exposed to the inlet fluid pressure of pressure balancing circuit 680, the portion comprising a circular, inner axially-projected surface area 682 defined by a diameter 684 that is equal to a diameter of the contra-rotating seal assembly 578 of compressor assembly 600. Therefore, similar to the operation of the pressure balancing circuit 562 of compressor assembly 500, the pressure balancing circuit 680 of compressor assembly 600 reduces the net downwards thrust load applied to lower shaft assembly 650 by balancing the downwards thrust applied to the inner axially-projected surface area 682 of lower shaft assembly 650 with a corresponding upwards thrust load applied to lower shaft assembly 650 from the inlet fluid pressure exposed to a lower end of lower shaft assembly 650. Additionally, in this embodiment, outlet fluid flow that has leaked past seals 570, 574, and/or 578 and into pressure balancing circuit is recirculated to the fluid inlets of inner housing 510 via pressure balancing passages 654, 674 (indicated by arrows 686).

Unlike the pressure balancing circuit 562 of compressor assembly 500, where inlet fluid pressure was communicated to circuit 562 via annular pressure balancing passage 511 formed between inner housing 510 and drum 212, inlet fluid pressure is communicated to the pressure balancing circuit 680 of compressor assembly 600 via the plurality of pressure balancing passages 654 formed within the inner shaft 652 of lower shaft assembly 650. In some applications, it may be preferable to communicate inlet fluid pressure via pressure balancing passages 654 of internal shaft 652 in lieu of an annular passage formed between drum 212 and inner housing 510 (e.g., due to spatial constraints or other limitations constraining the design of the compressor assembly). Additionally, given that final stage impeller 630 does not include an internal passage 630, the cross-sectional area of final stage impeller 630 may be greater than the final stage impeller 554 of compressor assembly 500, and thus, final sage impeller 630 of compressor assembly 600 may be able to withstand relatively greater torque, centrifugal loads, and thrust loads than final stage impeller 554.

Figure 12:
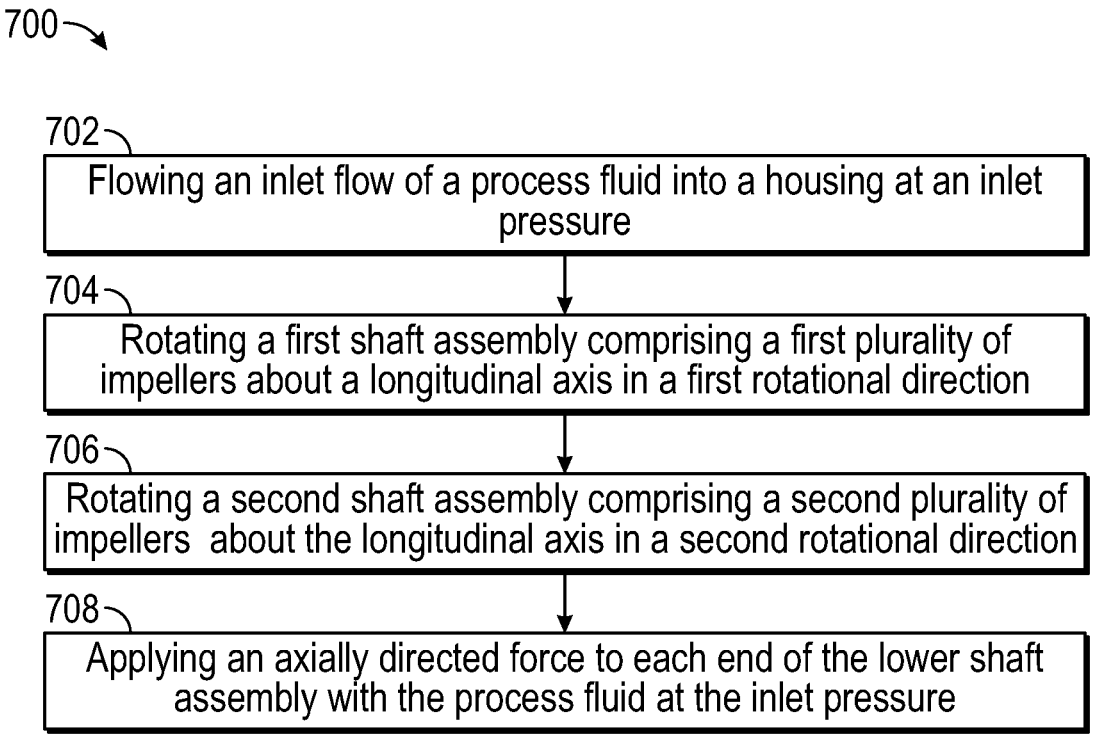
FIG. 12 is a flowchart depicting an embodiment of a method for compressing a process fluid in accordance with principles disclosed herein.

Referring to FIG. 12, a flowchart of a method 700 for compressing a process fluid is shown. At block 702 of method 700, an inlet flow of a process fluid is flowed into a housing at an inlet pressure. In some embodiments, block 702 includes flowing inlet fluid flow 125 into outer housing 120 of compressor assembly 100 at an inlet fluid pressure. In other embodiments, block 702 comprises flowing inlet fluid flow 125 into the outer housing 502 of compressor assemblies 500 and/or 600 at the inlet pressure. At block 704 of method 700, a first shaft assembly disposed in the housing and comprising a first plurality of impellers about a longitudinal axis in a first rotational direction. In some embodiments, block 704 comprises rotating upper shaft assembly 200, including impellers 202, about central axis 105 in a first rotational direction. In other embodiments, block 704 comprises rotating upper shaft assemblies 530, 610 about central axes 505, 605, respectively in the first rotational direction.

At block 706 of method 700, a second shaft assembly disposed in the housing and comprising a second plurality of impellers interleaved with the first plurality of impellers is rotated about the longitudinal axis in a second rotational direction opposite the first rotational direction. In some embodiments, block 706 comprises rotating lower shaft assembly 300, including impellers 302, about central axis 105 in a second rotational direction. In other embodiments, block 706 comprises rotating lower shaft assemblies 300, 650 about central axes 505, 605, respectively in the second rotational direction. At block 708 of method 700, an axially directed pressure force is applied to each end of the lower shaft assembly with the process fluid at the inlet pressure. In some embodiments, block 708 comprises communicating a portion of the inlet fluid flow 125 at the inlet pressure to a pressure balancing chamber (e.g., pressure balancing chambers 238, 560, and 632) positioned axially between an upper shaft assembly (e.g., upper shaft assemblies 200, 530, and 610) and a lower shaft assembly (e.g., lower shaft assemblies 300, and 650) via a pressure balancing circuit (e.g., pressure balancing circuits 150, 562, and 680) that includes the pressure balancing chamber, thereby applying a pressure force against an upper end of the lower shaft assembly via fluid disposed in the pressure balancing chamber at the inlet pressure.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A contra-rotating compressor for compressing a process fluid, comprising:

a first motor rotatably coupled with a first shaft assembly disposed in a housing and rotatable about a longitudinal axis, the first shaft assembly comprising an outer shaft, and a first plurality of impellers coupled to the outer shaft, wherein the outer shaft comprises a final stage that includes a final impeller of the first plurality of impellers;

a second motor rotatably coupled with a second shaft assembly disposed in the housing and rotatable about the longitudinal axis, the second shaft assembly comprising a second plurality of impellers interleaved with the first plurality of impellers;

a first passage extending through the housing; and a second passage extending through the final stage;

wherein the first motor is configured to rotate the first shaft assembly in a first rotational direction to exert a force on the process fluid in an axial direction;

wherein the second motor is configured to rotate the second shaft assembly in a second rotational direction opposite the first rotational direction to exert a force on the process fluid in the axial direction;

wherein a radially inner end of the final impeller is coupled to an inner cylindrical member of the final stage and a radially outer end of the final impeller is permitted to flex relative to the outer cylindrical member of the final stage.

2. The compressor of claim 1, wherein the final stage comprises:

the inner cylindrical member;

an outer cylindrical member comprising an outlet port;

an annular shoulder extending between the inner cylindrical member and the outer cylindrical member; and an annular channel formed between the inner cylindrical member and the outer cylindrical member and terminating the annular shoulder, wherein the final impeller is positioned in the annular channel.

3. The compressor of claim 2, further comprising a pressure balancing circuit configured to be in fluid communication with an inlet flow of the process fluid at an inlet pressure, wherein the pressure balancing circuit comprises a chamber positioned axially between the final stage and the second shaft assembly.

4. The compressor of claim 3, wherein the pressure balancing circuit further comprises the first and second passages.

5. The compressor of claim 1, further comprising:

a first pair of annular seals between the final stage and an inner surface of the housing, the pair of annular seals being configured to permit relative rotation between the final stage and the housing; and a third annular seal positioned between an outer surface of the final stage and an inner surface of the second shaft assembly, the third annular seal configured to permit contra-rotation between the final stage and the second shaft assembly.

* * * * *